US010808498B2

(12) United States Patent
Farley

(10) Patent No.: US 10,808,498 B2
(45) Date of Patent: Oct. 20, 2020

(54) METHODS AND APPARATUS RELATED TO AN EXPANDABLE PORT COLLAR

(71) Applicant: Weatherford Technology Holdings, LLC, Houston, TX (US)

(72) Inventor: Douglas Brian Farley, Missouri City, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 14/521,556

(22) Filed: Oct. 23, 2014

(65) Prior Publication Data

US 2016/0115764 A1 Apr. 28, 2016

(51) Int. Cl.
*E21B 33/14* (2006.01)
*E21B 34/14* (2006.01)
*E21B 43/10* (2006.01)

(52) U.S. Cl.
CPC ..... *E21B 33/14* (2013.01); *E21B 34/14* (2013.01); *E21B 43/108* (2013.01)

(58) Field of Classification Search
CPC ..... C09K 8/422; C09K 8/426; C09K 8/92; E21B 33/14; E21B 43/108
USPC ..... 166/285
See application file for complete search history.

(56) References Cited

U.S. PATENT DOCUMENTS 2,675,874 A * 4/1954 Springer ..... E21B 34/14 166/115
3,552,486 A * 1/1971 Burns ..... E21B 33/124 166/147
4,776,395 A * 10/1988 Baker ..... E21B 33/124 166/184
6,702,030 B2 3/2004 Simpson
7,121,351 B2 * 10/2006 Luke ..... E21B 29/10 166/382
2012/0186808 A1 * 7/2012 Lively ..... E21B 17/1028 166/241.6
2013/0081817 A1 * 4/2013 Norrid ..... E21B 34/102 166/305.1
2015/0034332 A1 * 2/2015 Merron ..... E21B 34/14 166/373

FOREIGN PATENT DOCUMENTS

EP 0618345 A1 10/1994
WO 0194743 A2 12/2001

OTHER PUBLICATIONS

United Kingdom Combined Search and Examination Report dated May 6, 2016, for United Kingdom Patent Application No. GB1518634.9.
Canadian Office Action dated Mar. 8, 2017, for Canadian Patent Application No. 2,909,368.

* cited by examiner

*Primary Examiner* — Zakiya W Bates
*Assistant Examiner* — Ashish K Varma
(74) *Attorney, Agent, or Firm* — Patterson + Sheridan, LLP

(57) ABSTRACT

A method and apparatus for cementing a casing string in a wellbore includes installing an expandable port collar in the casing string; providing cement from the casing string through at least one aperture in a wall of the port collar to an annular area surrounding the port collar; and expanding the port collar to increase its inner diameter.

22 Claims, 16 Drawing Sheets

METHODS AND APPARATUS RELATED TO AN EXPANDABLE PORT COLLAR

BACKGROUND OF THE INVENTION

1. Field of the Invention

Embodiments of the present invention generally relate to expandable valves and more specifically relates to methods and apparatus for cementing in a wellbore using expandable port collars.

2. Description of the Related Art

Wellbores are formed by drilling and then are lined with tubular strings ("casing strings" or "liner strings") that are subsequently cemented in place. Once a length of wellbore is formed, lined and cemented, a new section is formed. Throughout the process, drilling fluid is circulated through the wellbore to facilitate the expulsion of cuttings and to prevent a sudden increase in pressure from a formation. The length of each section is limited by the weight of the column of fluid that acts on the walls of the earthen bore as the section gets longer. Once the section of wellbore is lined and cemented, the formations are isolated and protected from the hydrostatic pressure of fluid.

In some instances a lower-most section is cemented in two stages. The first stage cement is pumped upwards from the bottom of the wellbore but does not extend all the way up to a lower end of the previously cemented casing due to the pressures created by the weight of the cement. Rather, to avoid the possibility of cement flowing into and damaging a formation, the cement job is stopped early, leaving an annular area of un-cemented casing. In these instances, a valve or port collar previously installed in the casing string is utilized to form a fluid path between cement pumped from the surface and the un-cemented annular area between the casing and the borehole. In a typical port collar, an inner sleeve aligns or misaligns a series of ports. The structure necessarily means the walls of the port collar are thicker than the walls of the casing in which the port collar is installed. Because the port collar must be run into the well in the casing string, they are usually designed with an outer diameter that is no larger than the casing. The interior therefore is of a smaller diameter and can pose problems for tools passing through the port collar before and after its use. If the port collar is built with an inner diameter large enough to provide the same "drift" as the casing, its enlarged outer diameter creates problems when it's run into a wellbore, often through previously installed strings of casing that provide little clearance.

There is a need therefore for a downhole cement valve or port collar that can be remotely opened or closed and that does not have a limiting inner or outer diameter while still providing pressure integrity.

SUMMARY OF THE INVENTION

The present invention generally relates to expandable valves and more specifically relates to methods and apparatus for cementing in a wellbore using expandable port collars. In one embodiment, a method and apparatus for cementing a casing string in a wellbore includes installing an expandable port collar in the casing string; providing cement from the casing string through at least one aperture in a wall of the port collar to an annular area surrounding the port collar; and expanding the port collar to increase its inner diameter.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
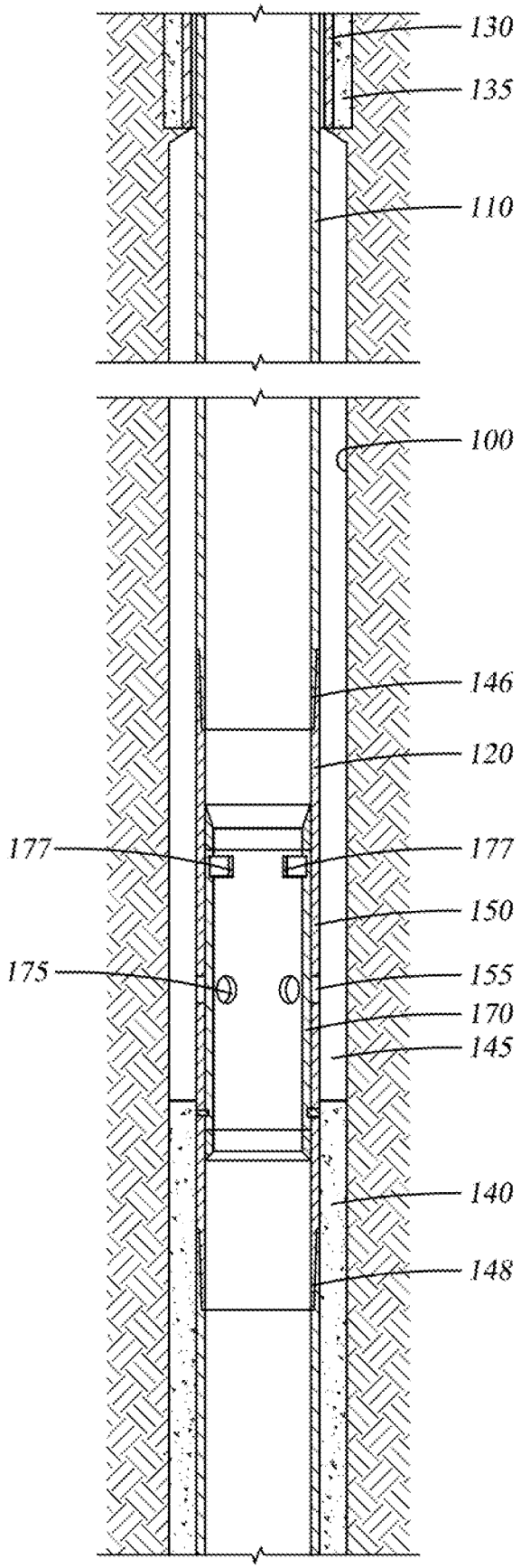
FIG. 1 is a section view of a wellbore having a casing string and an expandable port collar therein.

FIG. 1 is a section view of a wellbore 100 having a casing string 110 and an expandable port collar 120 therein. The outside diameter (OD) of the port collar is flush or nearly flush with the outside diameter of the casing. Due to the pressure requirements of the casing and inner sleeve, the inner sleeve may have sufficient wall thickness creating a smaller inside diameter (ID) than that of the casing. The wellbore includes an upper casing string 130 that has been previously cemented leaving an annular area 135 between the casing and the wellbore wall filled with cement. Below the previously cemented string, a new section of wellbore 100 has been formed. By using an under-reamer (not shown) the new section is formed with a diameter sufficient to allow for an adequate cement sheath around the next string of casing. In this manner, the wellbore 100 can be extended without the reduced diameters that are necessary without under-reaming. In FIG. 1, an annular area 140 surrounding the lower portion of the new casing string has also been cemented, the first of a two-part cement job wherein the upper portion 145 is initially left un-cemented to avoid subjecting that area of the new section to formation-damaging pressures from the cementing fluid.

The port collar 120 is installed in the string at a location predetermined to be adjacent the un-cemented section 145. The collar includes threads 146, 148 at each end forming a connection with the casing above and below. The purpose of the port collar is to provide a fluid path from an interior of the string to the un-cemented annular area 145. While not shown, the lower cement job 140 is accomplished by injecting cement through the casing string utilizing a valve at the lower end of the casing to prevent "U-tubing" of the cement back into the lower end due to its fluid weight. Cementing strings of casing in a wellbore from a lower end of the string is well known in the art.

The port collar 120 is shown in more detail in subsequent Figures, but it includes housing 150, and an inner rotatable sleeve 170 that is rotatable relative to the housing in order to align or mis-align a series of ports 155, 175 formed in each part to create any number of apertures between an interior and exterior of the port collar. In FIG. 1, the port collar is shown in a "closed" position with the ports 155, 175 misaligned as they would be when the casing string is initially run into the wellbore before the lower portion 140 is cemented. As is visible in the Figures, the outer diameter of the un-expanded housing 150 is the same as the outer diameter of the casing string 110 and the inner sleeve 170 creates a smaller inner diameter in the area of the port collar. The port collar 120 also includes landing slots 177 formed in an inner diameter of the sleeve 170 and extending inwardly from the housing 150 to facilitate the landing of a cementing tool and rotation of the sleeve as will be explained herein.

Figure 2:
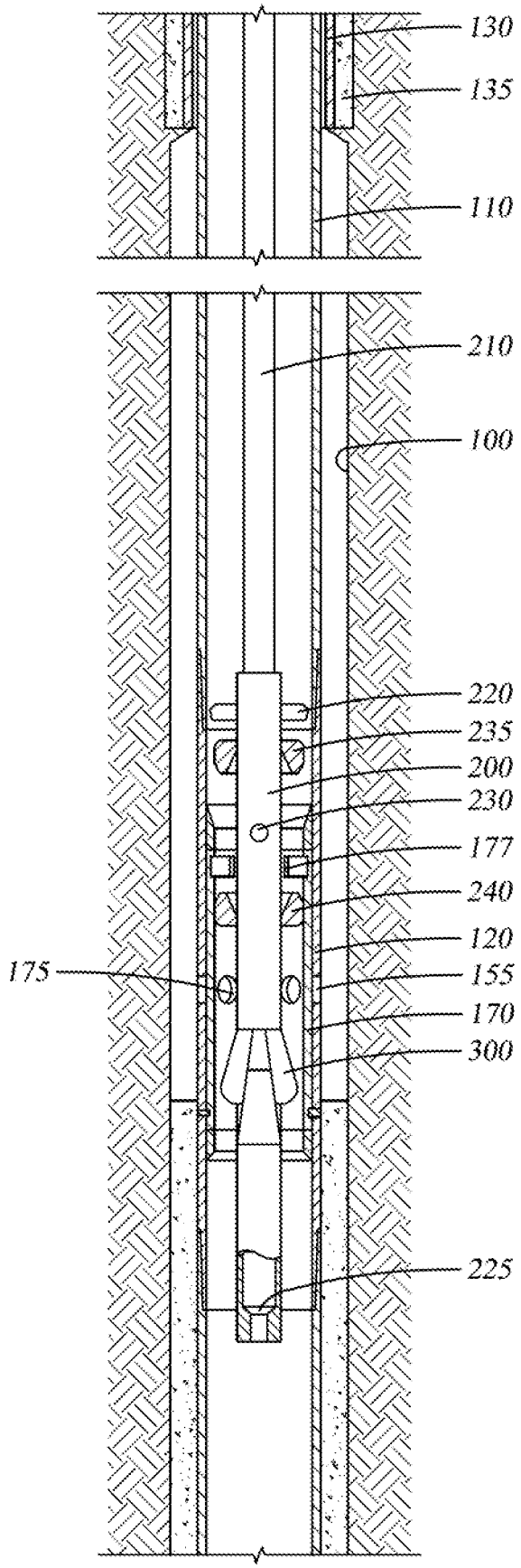
FIG. 2 is a section view of the wellbore with a cementing tool, and expansion cone attached to a work string and showing the cementing tool partially disposed in the port collar.

FIG. 2 is a section view of the wellbore 100 with a cementing tool 200, and a two position expander 300 attached to a work string 210. Visible in FIG. 2 are keys 220 located on the cement tool for landing in the landing slots 177 of the port collar 120. The work string 210 is run in from the surface and is typically made of drill string or other relative small diameter tubulars through which fluid can be pumped. Installed at the lower end of the work string is a ball seat 225 that permits the bore of the string to be sealed in order to develop pressure in the string to operate a tool or utilize an alternative fluid path from the string. Above the ball seat 225 the expander 300 is shown in its un-expanded position. The expander is capable of assuming a second, expanded diameter position. Above the expander, the cementing tool 200 includes at least one port 230 for permitting cement to pass from an interior of the work string to an area outside the tool. Two sealing members 235, 240 in the form of cup seals are installed above and below the cementing port to isolate an annular area formed between the cementing tool and the interior of the port collar. The cup seals are sized whereby they form a seal only in the smaller inner diameter area of the port collar. For example, in FIG. 2 the upper seal 235 is not in contact with the casing wall but, in the interior of the port collar, the lower seal 240 is in sealing contact with an inner surface of the collar 120.

Figure 3:
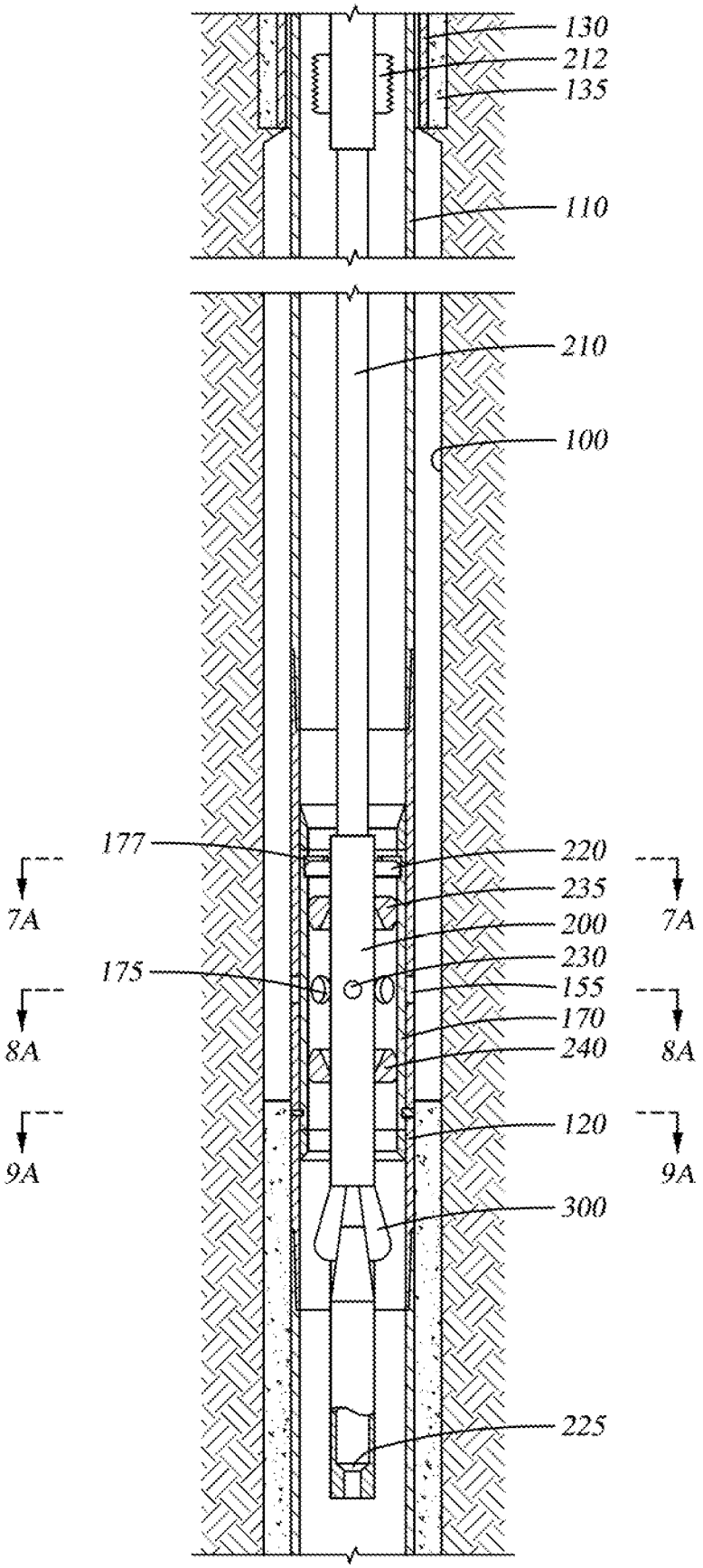
FIG. 3 is a section view of the wellbore with the cementing tool fixed within the port collar.

FIG. 3 is a section view showing the cementing tool 200 landed in the port collar 120 with the keys 220 of the tool engaged in landing slots 177. An anchor 212 on the work string 210 above the tool is optionally provided to facilitate the axial movement of the cement tool and expander. In one embodiment, a jack provides upward movement from a location in the wellbore as will be explained herein.

Figure 4:
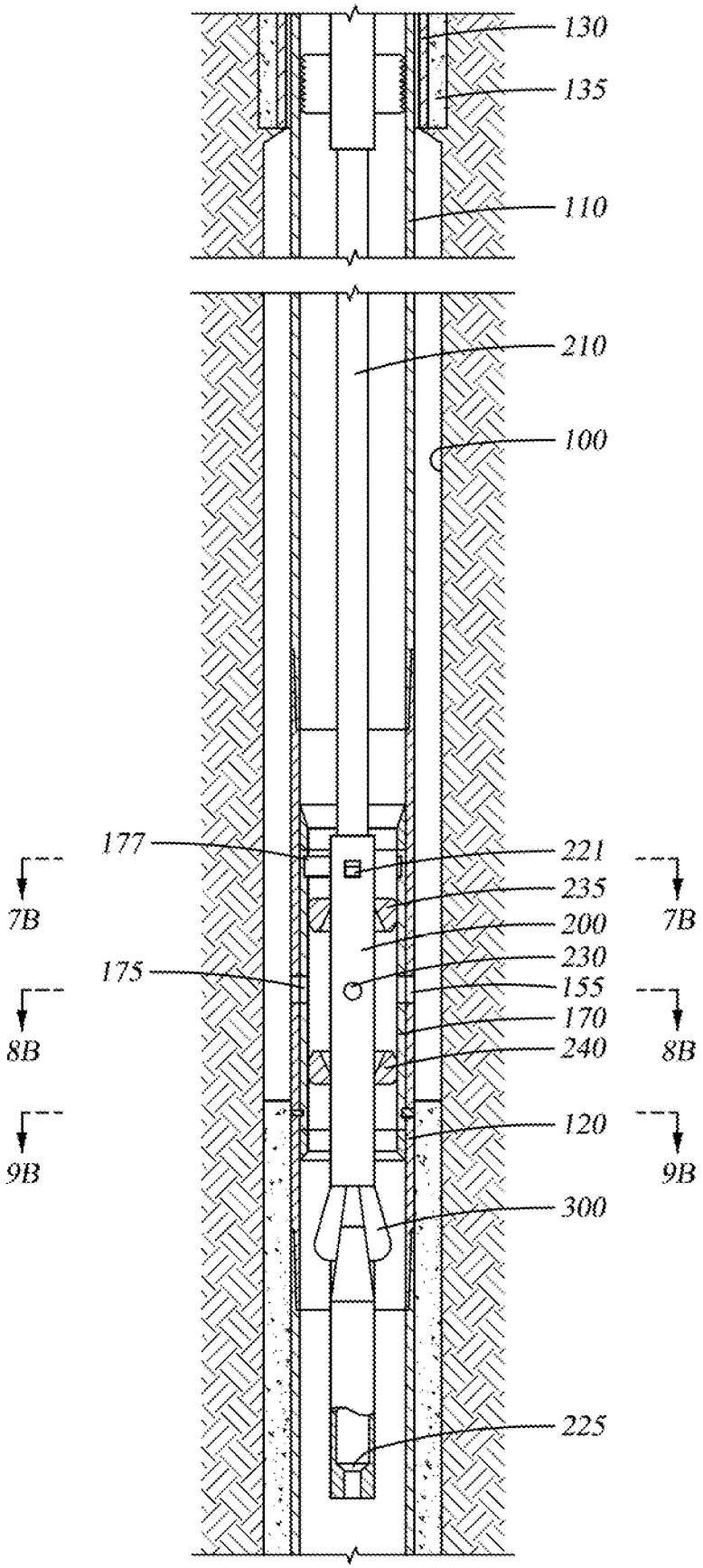
FIG. 4 is the section view of FIG. 3 after the port collar has been shifted from a "closed" to an "open" position.
Figure 7A:
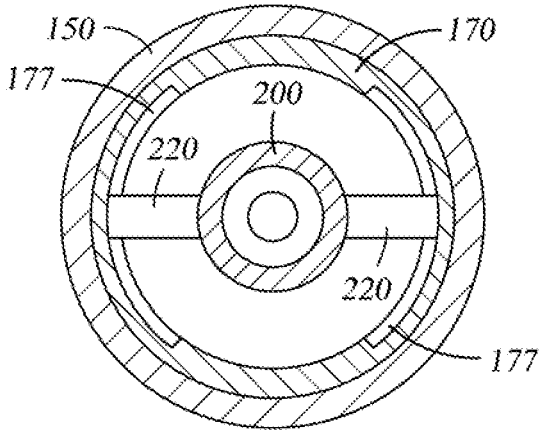
FIGS. 7A-7C are section views taken from FIGS. 3, 4 and 6 showing the interaction of keys of the cementing tool and landing slots of the port collar between "open" and "closed" positions of the port collar.

FIG. 4 is a section view illustrating the components of FIG. 3 after the work string 210 has been rotated in order to align the housing and sleeve ports 155, 175 of the port collar 120 and open a fluid path between the interior and exterior of the port collar. Movement of various portions of the assembly to open the port collar is shown in a series of FIGS. 7A-B, 8A-B, and 9A-B taken at various axial locations along the port collar. For example, FIGS. 7A, 8A and 9A illustrate various portions of the assembly with the housing 155 and sleeve 175 ports misaligned (8A) and the port collar 120 in the "closed" position as it appears in FIG. 3. FIG. 7A illustrates the keys 220 landed in landing slots 177 formed in the rotatable sleeve 170. As shown, the slots are formed with a fairly wide arc to facilitate the landing of the keys 220 as the cement tool is lowered into the port collar. In the embodiment shown, the slots 177 are made with an arc of about 45 degrees.

The purpose of the keys 220 and slots 177 is to rotate the rotatable sleeve 170 relative to the housing 150 to align and misalign the ports 155, 175 in order to open and close the port collar 120. FIG. 9A shows the interaction of the stop pins 151*a, b* and stop pin grooves 178, 180 in which they are installed. As shown, the pins 151*a, b* are inwardly extending pins in the port collar housing 150 and the pin grooves 178 are formed in an outer surface of the rotatable sleeve 170. The purpose of the stop pins and pin grooves is to limit the rotation of the rotatable sleeve to ensure that ports 155, 175 are completely aligned or misaligned.

Figure 7B:
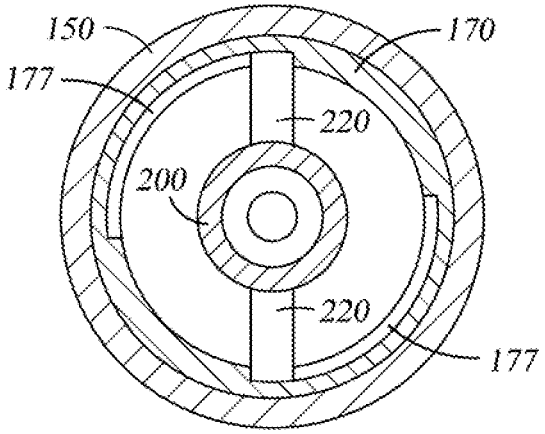
Figure 8A:
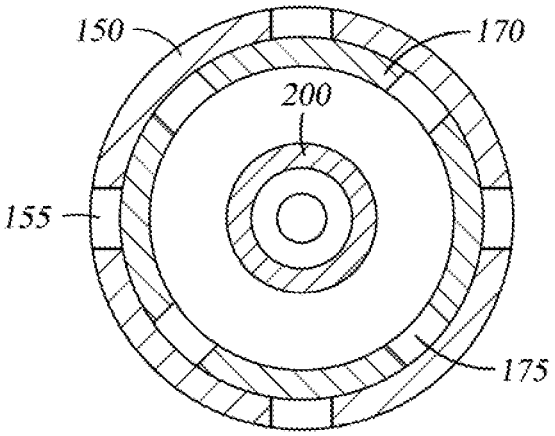
FIG. 8A-8C are section views taken from FIGS. 3, 4 and 6 showing the alignment and mis-alignment of ports formed in the port collar.
Figure 8B:
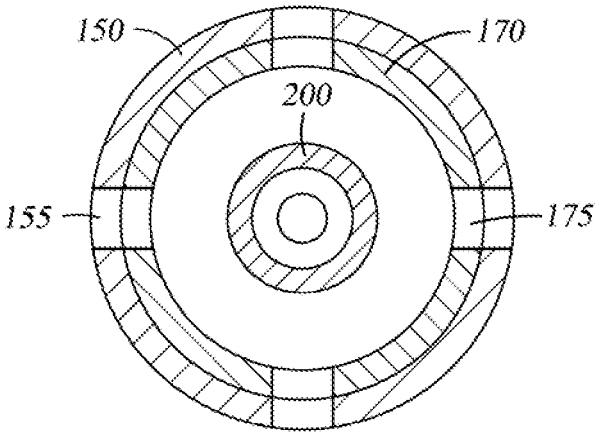
Figure 9A:
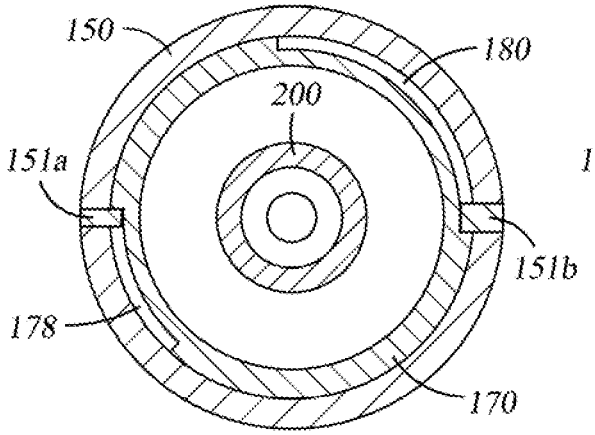
FIG. 9A-9C are section views taken from FIGS. 3, 4 and 6 showing the interaction of stop pins and pin grooves as the port collar is shifted between positions.
Figure 9B:
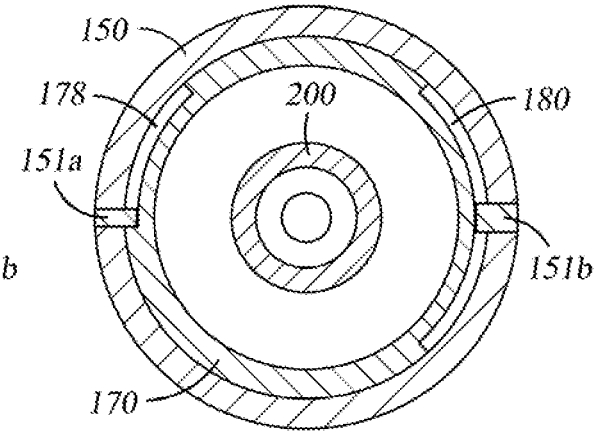

FIGS. 7, 8, and 9 show the previously described parts after the rotatable sleeve 170 of the port collar has been rotated to a position in which the ports 155, 175 are aligned and the port collar 120 is in an "open" position (FIG. 8B). Considering FIG. 7B, the work string 210, and with it the keys 220 have been rotated about 90 degrees to a point where one of the stop pins 151*a* (FIG. 9B) has encountered a wall of a pin groove 178, thereby placing the tool in a position in which the ports 155, 175 are aligned and resulting in an assembly as it appears in FIG. 4.

Figure 7C:
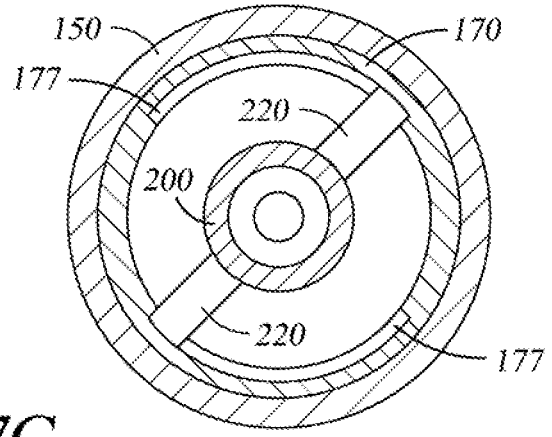
Figure 8C:
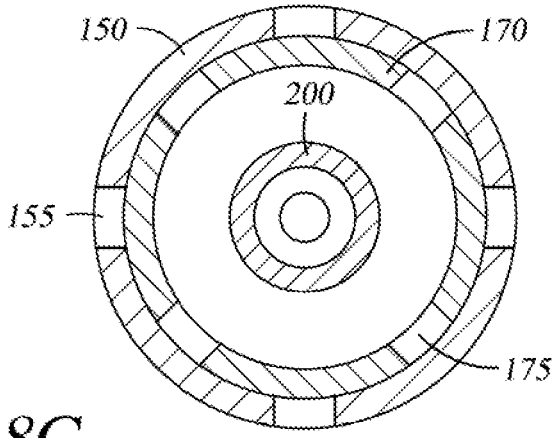
Figure 9C:
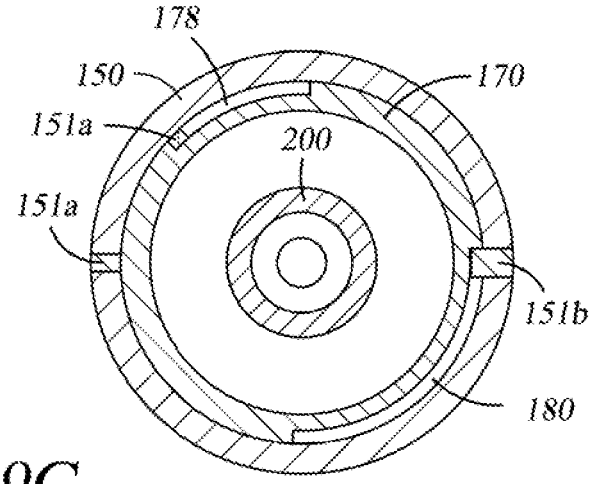

FIGS. 7, 8, and 9 show the various components of the assembly after the rotatable sleeve has been further rotated and returned to a "closed" position. Comparing FIG. 7B to 7C, the tool 210, keys 220 and sleeve 170 have been further rotated about 45 degrees in order to misalign the ports 155, 175 (FIG. 8C). As shown in FIG. 9C, further rotation was initially prevented by a stop pin 151*a* and stop groove 178. However, in order to re-close the port collar, the relatively weak stop pin 151*a* is fractured due to rotational force and rotation is eventually stopped by the interaction of a stronger stop pin 151*b* with a second stop groove 180.

Figure 5:
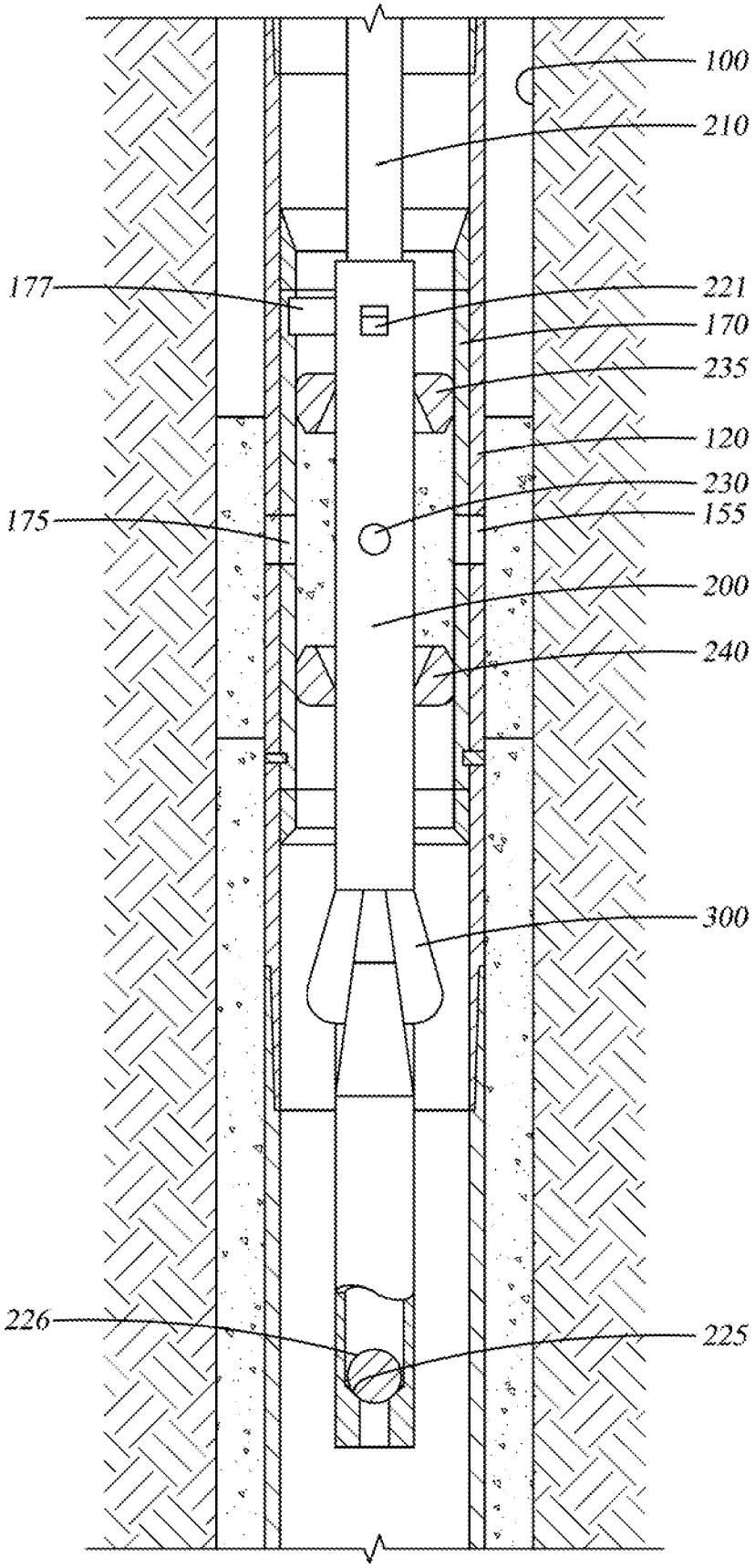
FIG. 5 is a section view of the wellbore showing an upper cement job in progress.
Figure 6:
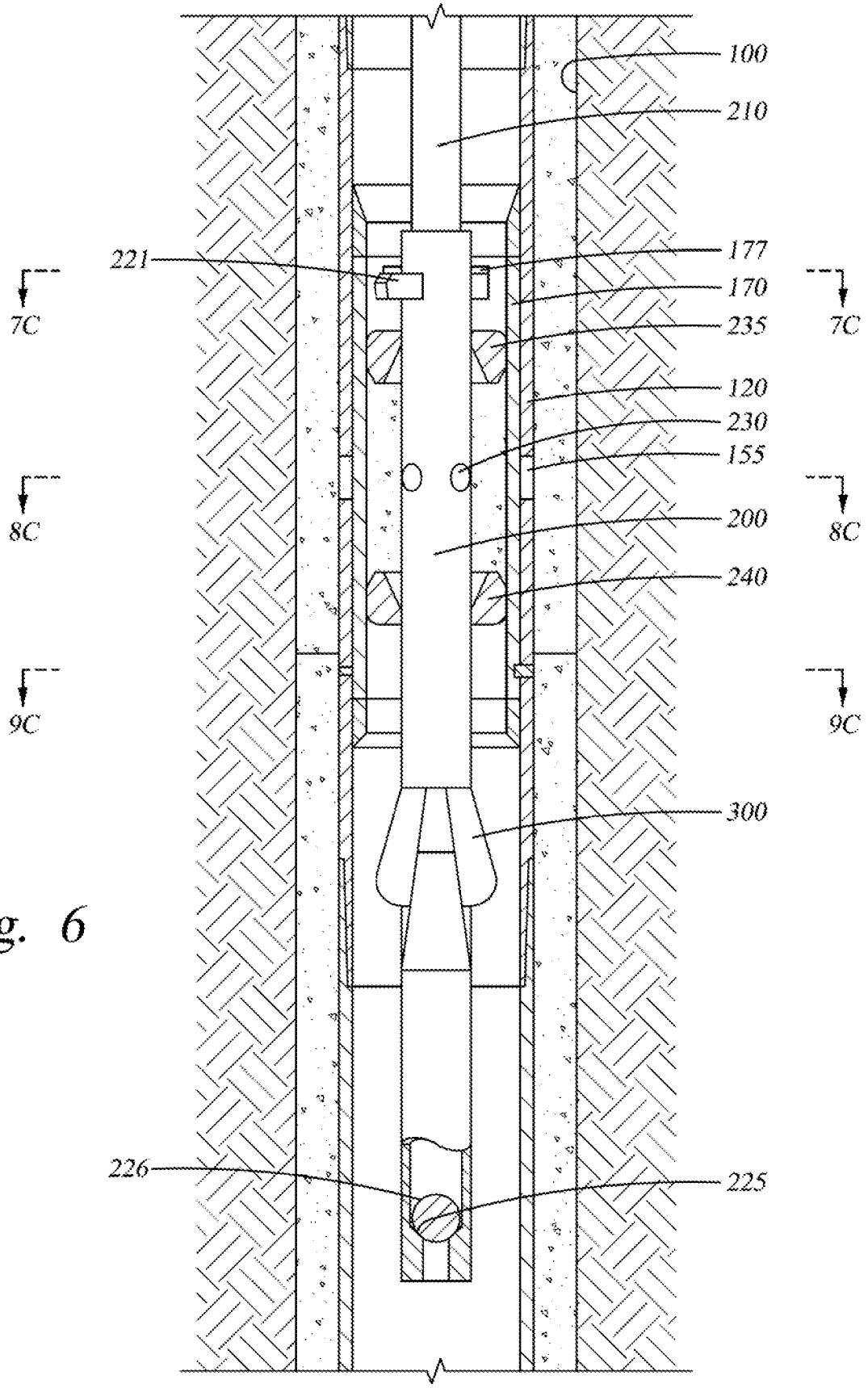
FIG. 6 is a section view of the wellbore showing the port collar having been returned to the "closed" position.

FIG. 5 is a section view of the wellbore 100 showing an upper cement job in progress. As shown, an annular area between the cementing tool 200 and an interior of the port collar 120 is sealed by the sealing members 235, 240 and cement is free to flow from port 230 through aligned ports 155, 175 of the open port collar 120 to complete the upper cement job. Prior to pumping cement through the work string 210 from the surface, a lower end of the tool is sealed by dropping a ball 226 into the ball seat 225 formed at the lower end of the string as it appears in FIG. 5. FIG. 6 is a section view of the wellbore showing the port collar 120 having been returned to the "closed" position after the upper cement job is complete. The position of the port collar in FIG. 6 corresponds to section views 7C, 8C and 9C.

Figure 10:
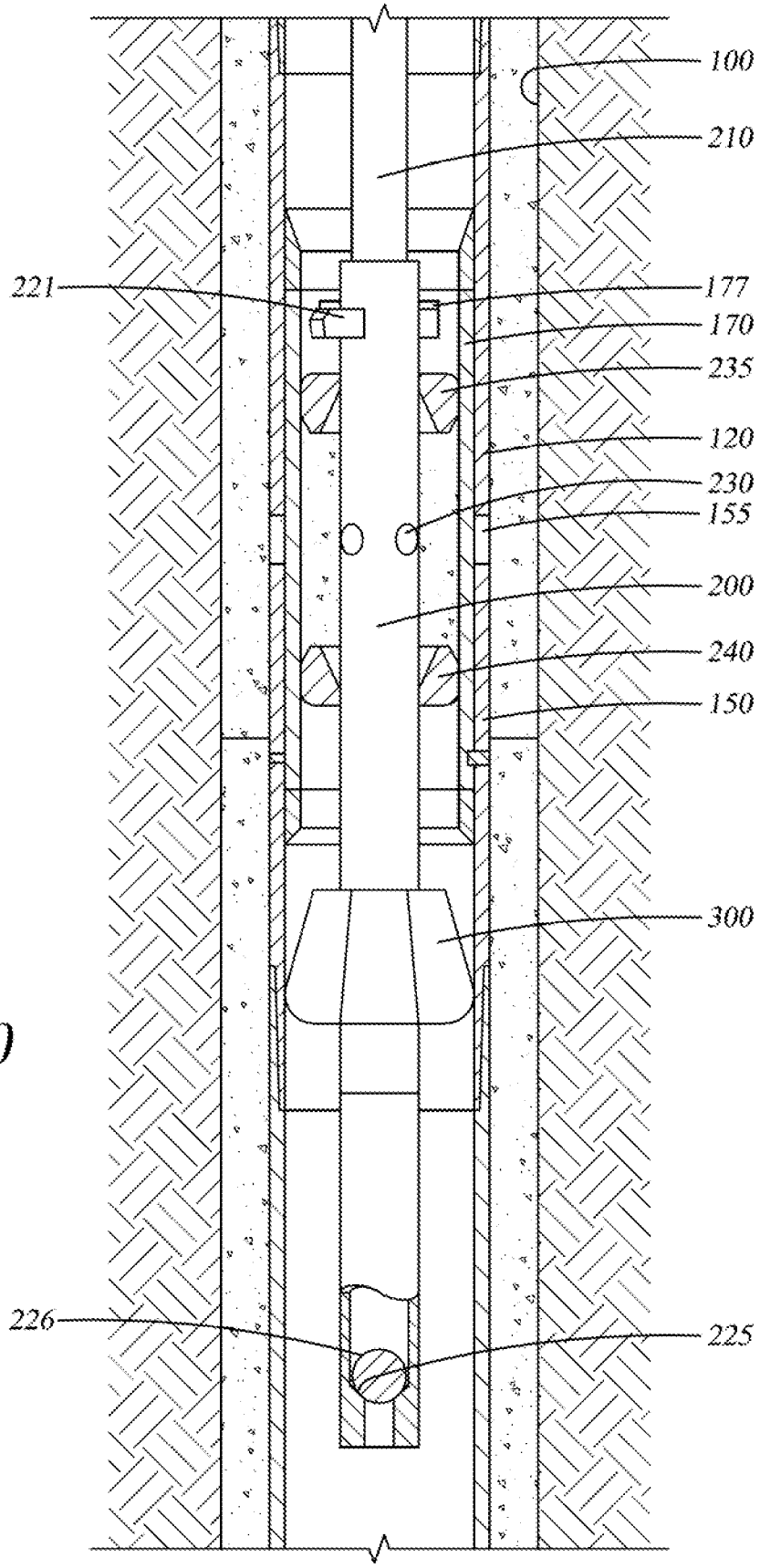
FIG. 10 is a section view of the assembly with the expandable cone in an expanded position.

FIG. 10 is a section view of the assembly with the expander 300 in an expanded position. In the embodiment shown, the expander is a two-position cone and is movable to an expanded position by fluid pressure developed in the work string above the sealed, lower end of the string. One version of a pressure actuated expandable cone is taught in U.S. Pat. No. 7,121,351. In addition to using pressure to actuate the cone, the patent teaches the use of fluid pressure to translate the expanded cone upwards in the wellbore in order to expand a predetermined length of tubular string. The '351 patent is incorporated herein by reference in its entirety. In another embodiment, the expander utilizes compliant, extendable members disposed around an expander body that are radially extended via fluid pressure. Thereafter, with the members extended, the expander is rotated in the wellbore to provide a complete expansion of a surrounding tubular member. One version of such an expander is taught in U.S. Pat. No. 6,702,030 and that patent is incorporated herein by reference in its entirety. In one embodiment, upward movement of the expander is performed using a jack-like device that is located on the work string some distance above the assembly.

Figure 11:
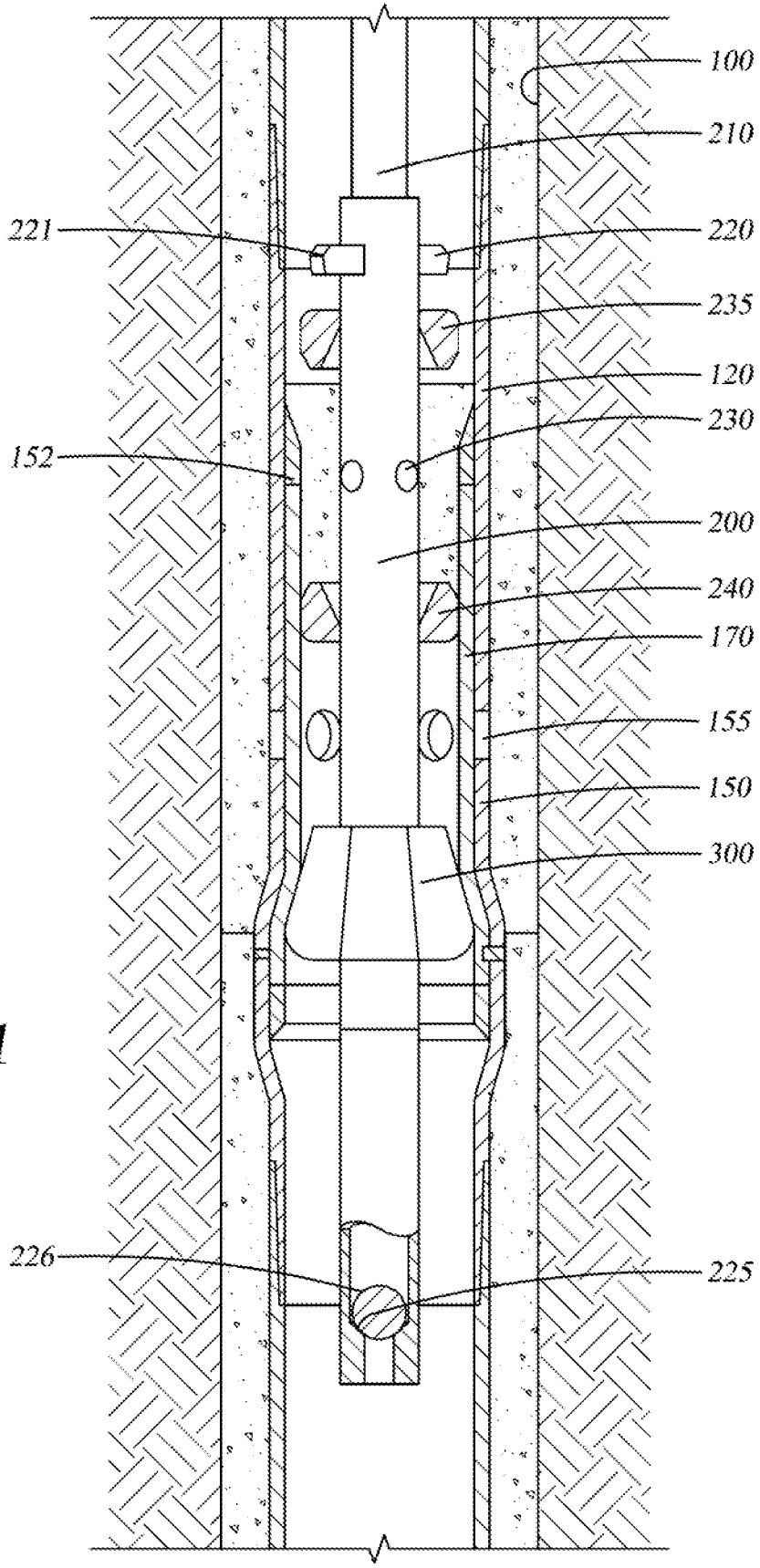
FIG. 11 is a section view of the wellbore showing the expanded cone having moved upwards in the wellbore relative to the port collar to expand a lower portion of the port collar.

FIG. 11 is a section view of the wellbore 100 showing the expander 300 having moved upwards in the wellbore relative to the port collar 120 to expand a lower portion of the port collar, including a portion of the housing 150 and rotatable sleeve 170. A sloped surface 221 formed on each of the biased landing keys 220 has permitted them to lift away from the landing slots 177 (not visible). Because the cement is still uncured in the annular area between the tool 200 and the rotatable sleeve 170, it does not hamper the movement of the assembly as it moves in an upwards direction. A non-rotating ring 152 is machined, welded or otherwise secured into an interior of the housing 150 to prevent upward movement of the sleeve 170 as it is being expanded.

Figure 12:
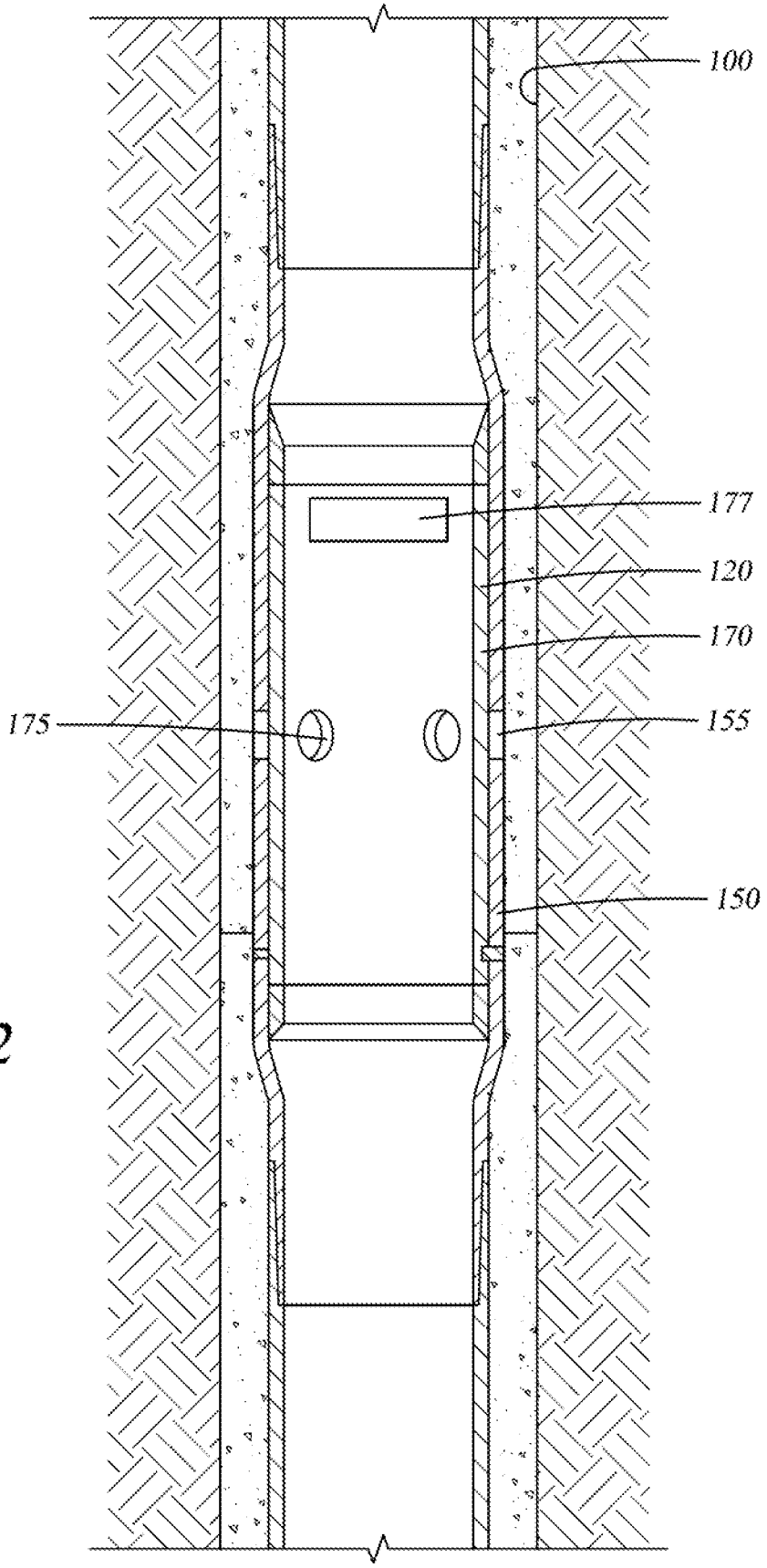
FIG. 12 is a section view of the wellbore showing the port collar completely expanded to leave an enlarged bore sufficient for subsequent construction of the well in the area of the port collar.

FIG. 12 is a section view of the wellbore 100 showing the port collar 120 completely expanded in the area of the rotatable sleeve 170 to leave an enlarged bore in the area of the sleeve. The combined wall thickness of the outer body and the inner sleeve is sufficient to support the pressure requirements of the well design. The increase in yield strength through cold working the inner sleeve and the outer body will also contribute to strengthen of the multi-stage cementer. The two sleeves expanded together with a metal seal therebetween create pressure integrity between inner sleeve and outer body. For example, there is a metal-to-metal seal between the outer surface of the sleeve and the inner surface of the port collar housing. As illustrated, the port collar 120 is left in a "closed" position with its inside diameter as large as the casing diameter above and below the collar. In FIG. 12, the work string 210 with its associated tools has been removed and any remaining fluid in the string has been allowed to drain via port 230 in the cementing tool 200. The expanded inner sleeve, expanded together with the outer body with minimal clearance between the two serves to increase the resistance to burst and collapse pressures. As stated, expanding the inner sleeve into the outer body can energize a metal-to-metal seal, coating, or change in metallurgy between the two pieces.

Figure 13:
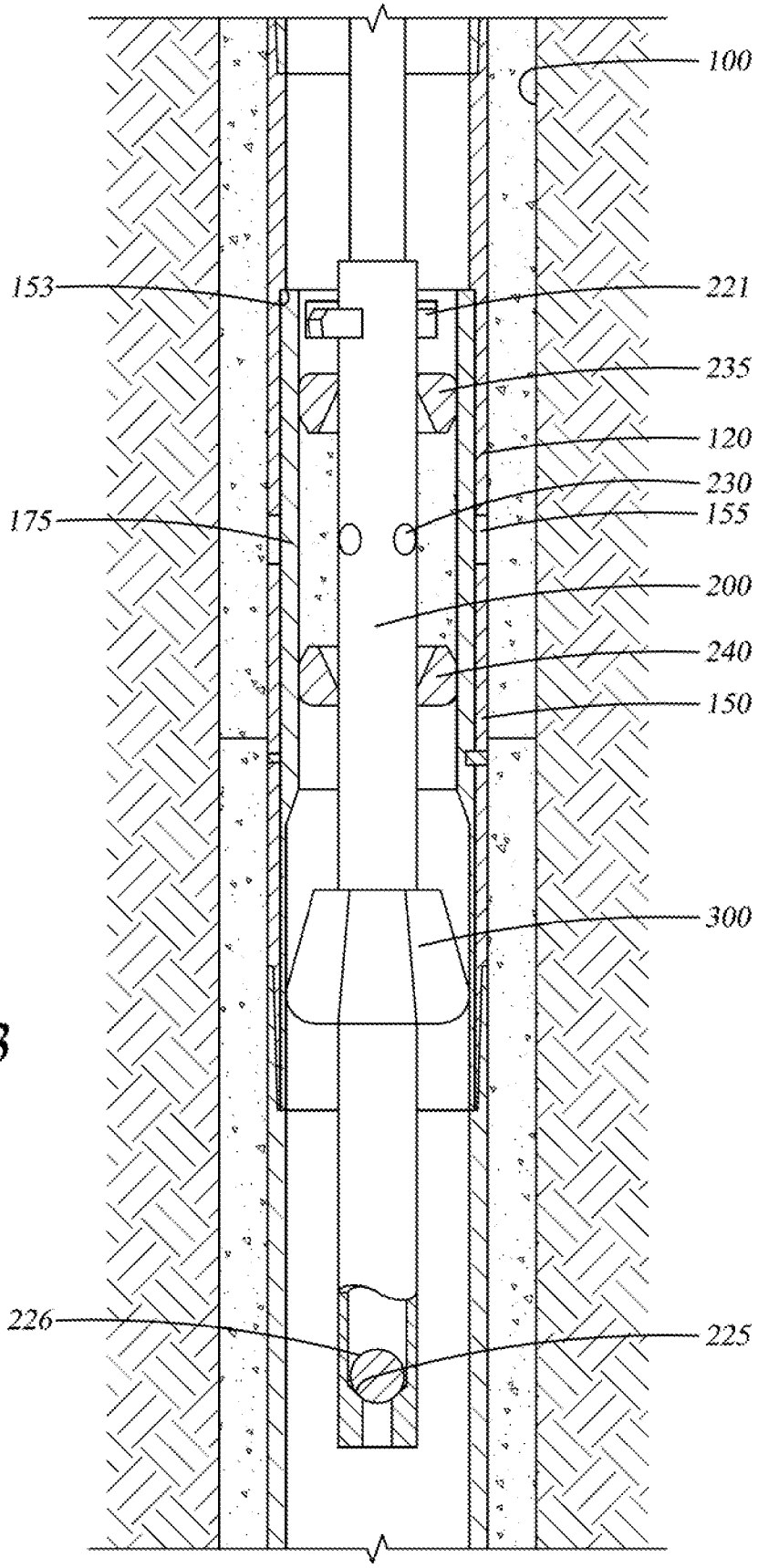
FIGS. 13-15 illustrate the port collar expanded in a second embodiment.
Figure 14:
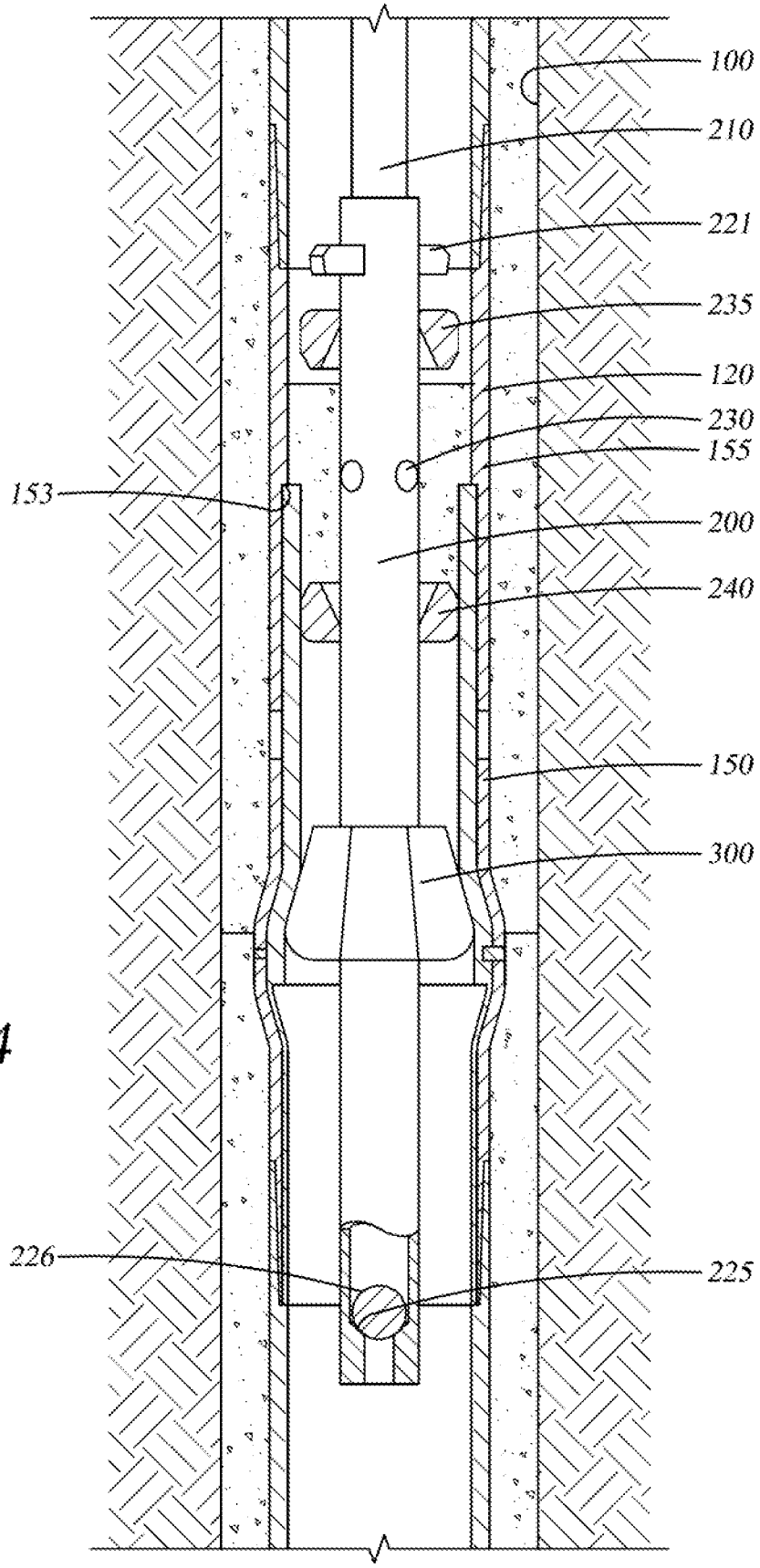
Figure 15:
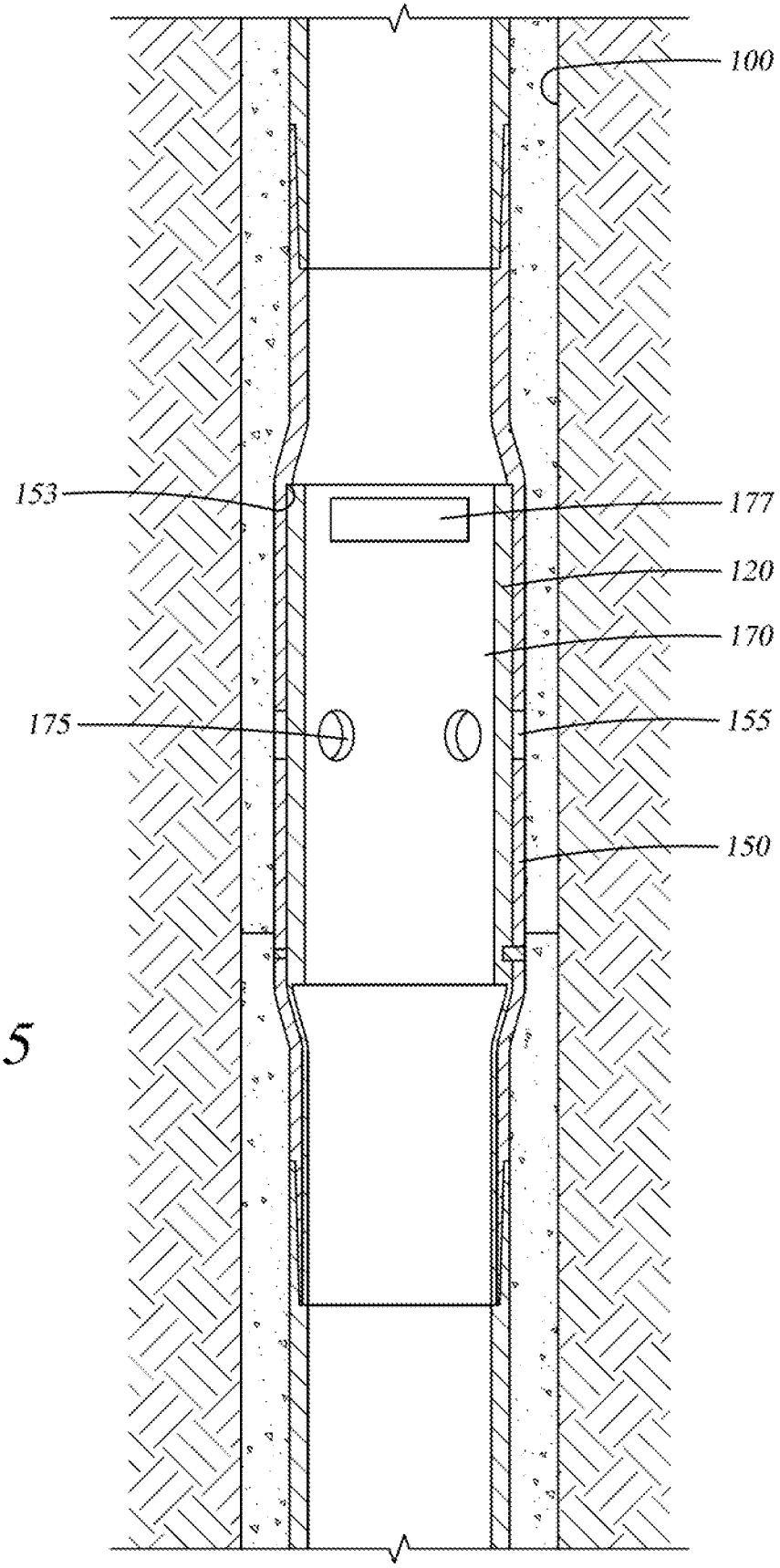

FIGS. 13-15 illustrate the port collar 120 expanded according to a second embodiment. As shown in the embodiment of FIG. 13, the housing 150 of the port collar is formed with a downwardly facing shoulder 153 to prevent the rotatable sleeve 170 from moving upwards as it is expanded. The shoulder 153 in the embodiment of FIGS. 13-15 replaces the ring 152 in the previous embodiment. Once again the result is an expanded port collar with an inside diameter as large as the casing string above and below, as shown in FIG. 15.

Figure 16:
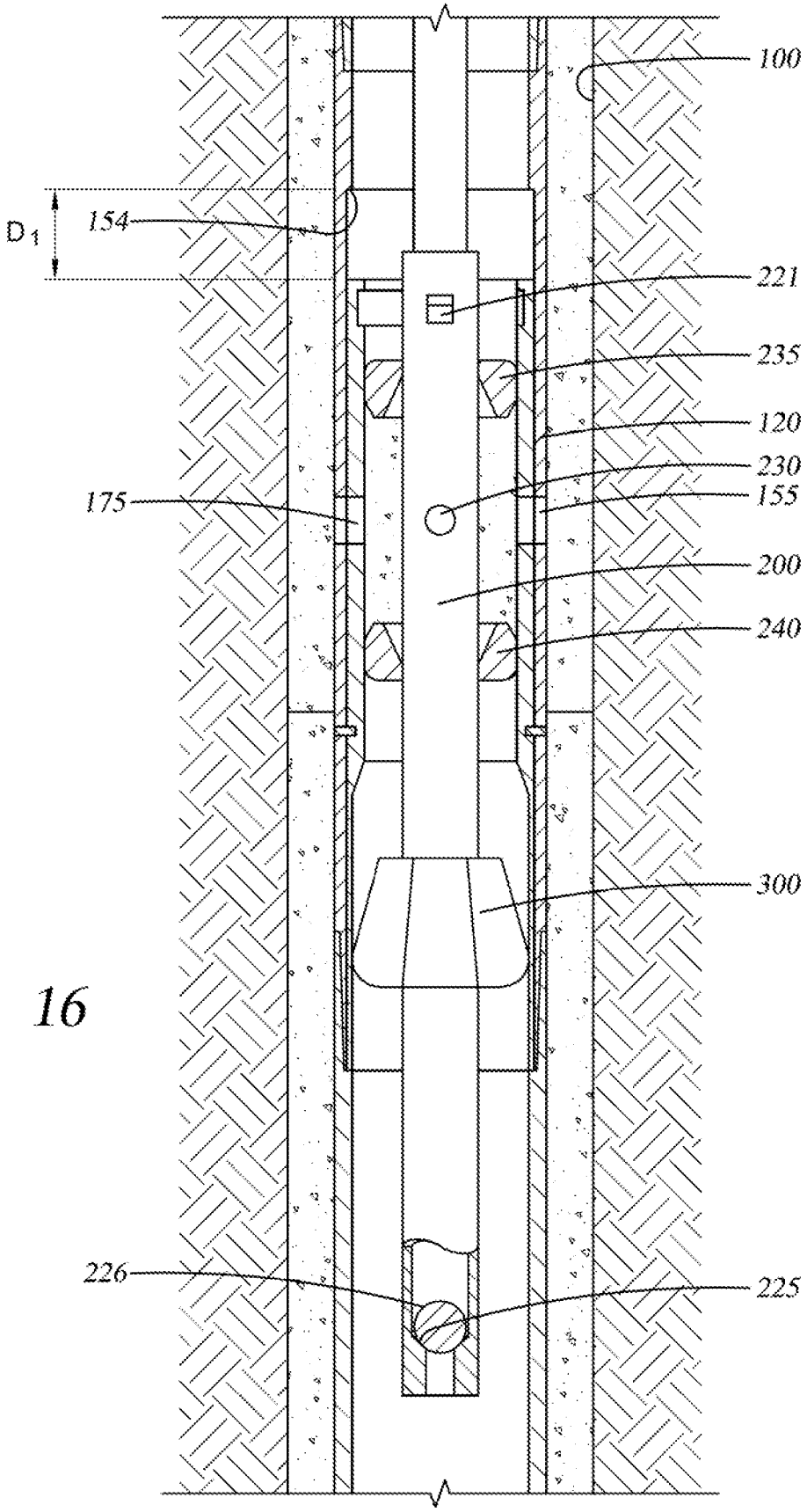
FIGS. 16-17 illustrate the port collar expanded in a third embodiment.
Figure 17:
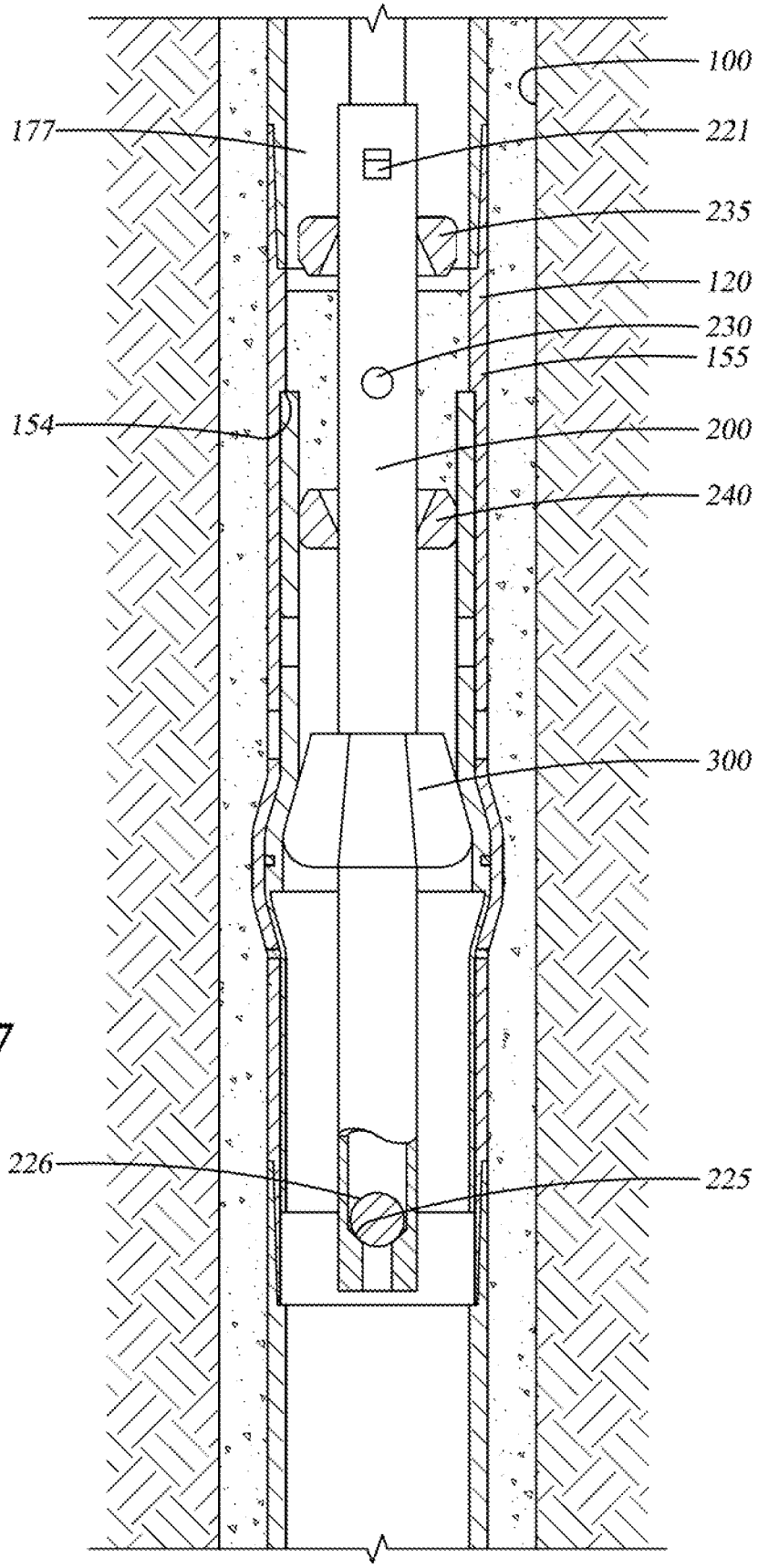

FIGS. 16-17 illustrate an embodiment wherein the port collar 120 is not reclosed due to rotation but is reclosed due to axial moment of the sleeve 170 relative to the housing 150. As shown, the sleeve is constructed and arranged to move upwards a predetermined distance D1 during expansion until it contacts a shoulder 154 formed in the inside diameter of the housing. During expansion, the sleeve 170 moves upwards the predetermined distance and then "shoulders out" at a location in the housing ensuring that the ports of the sleeve 175 and the housing 155 are misaligned axially.

While the foregoing is directed to embodiments of the present invention, other and further embodiments of the invention may be devised without departing from the basic scope thereof, and the scope thereof is determined by the claims that follow.

The invention claimed is:

1. A method of cementing a casing string in a wellbore comprising:

installing an expandable port collar in the casing string;

providing cement from a work string through at least one aperture in a wall of the port collar to an annular area surrounding the port collar, wherein the port collar includes a rotatable sleeve, the sleeve rotatable to open and close the at least one aperture, wherein the work string includes a cementing tool for rotating the sleeve; and expanding the port collar to increase its inner diameter; wherein:

the at least one aperture is opened by rotating the sleeve in a first direction until a first wall of a first groove in the sleeve encounters a first stop member, and the at least one aperture is closed by further rotating the sleeve in the first direction past the first stop member and until a second wall of a second groove in the sleeve encounters a second stop member.

2. The method of claim 1, wherein the inner diameter of the rotatable sleeve is expanded to a size substantially the same as the inner diameter of the casing.

3. The method of claim 2, wherein after the cement is provided, the at least one aperture is closed.

4. The method of claim 1, wherein the at least one aperture comprises a port in a body of the port collar and a mating port in the rotatable sleeve, the ports alignable to open the at least one aperture.

5. The method of claim 4, wherein the rotatable sleeve is an internal sleeve.

6. The method of claim 1, wherein prior to the supply of cement, a central bore of the work string is closed.

7. The method of claim 6, wherein the cement is supplied via at least one port in a wall of the cementing tool, the at least one port providing fluid communication between the work string and an interior of the port collar.

8. The method of claim 7, wherein after the cement is supplied, the at least one aperture is closed.

9. The method of claim 8, wherein expanding the port collar is performed with a two position expander, the first position providing a first outer diameter of the expander and the second position providing a larger, second diameter of the expander.

10. The method of claim 9, wherein the expander is disposed on the work string adjacent the cementing tool.

11. The method of claim 10, wherein the expander is located below the port collar during the cementing and is subsequently shifted to its second larger diameter position and pass through the port collar to expand the port collar.

12. The method of claim 1, wherein prior to expansion, the outer diameter of the port collar is substantially the same as an outer diameter of the casing.

13. The method of claim 1, further comprising:

lowering a tool into the casing string; and rotating the sleeve using the tool.

14. The method of claim 13, further comprising engaging the tool to the sleeve.

15. The method of claim 14, further comprising supplying cement from the tool to the casing string.

16. The method of claim 1 wherein providing the cement and expanding the port collar are performed in a single trip into the wellbore.

17. The method of claim 1, wherein rotating the sleeve in the first direction to open the aperture and further rotating the sleeve in the first direction to close the aperture comprise rotating the sleeve in the first direction by a total of less than 180 degrees.

18. A method of cementing a casing string in a wellbore comprising:

installing an expandable port collar in the casing string;

running a work string into the wellbore, the work string having a cementing tool and an expander disposed thereon;

landing the cementing tool in the port collar and opening at least one aperture in a wall of the port collar by rotating an interior sleeve in a first direction until a first wall of a first groove in the interior sleeve encounters a first stop member;

providing cement from the work string to an annular area between the port collar and the wellbore;

closing the at least one aperture by further rotating the interior sleeve in the first direction such that first wall moves past the first stop member, and until a second wall of a second groove in the interior sleeve encounters a second stop member; and using the expander to expand the port collar.

19. The method of claim 18, wherein rotating the interior sleeve is performed by rotating the work string in the first direction.

20. The method of claim 18, wherein rotating the interior sleeve in the first direction to open the aperture and further rotating the interior sleeve in the first direction to close the aperture comprise rotating the interior sleeve in the first direction by a total of less than 180 degrees.

21. A port collar for use in a casing string, comprising:

an outer body having at least one port in a wall thereof;

an inner rotatable sleeve, the sleeve having at least one port in a wall thereof, the ports of the body and the sleeve alignable to create an aperture;

a first position wherein the aperture is closed;

a second position wherein the aperture is open and a third position wherein the aperture is re-closed, wherein the second and third positions result from rotating the sleeve in a first direction;

a frangible first stop member configured to inhibit passage of the sleeve beyond the second position; and a second stop member configured to inhibit passage of the sleeve beyond the third position.

22. The port collar of claim 21, wherein rotating the sleeve from the first position to the third position comprises rotating the sleeve in the first direction by a total of less than 180 degrees.

* * * * *